United States Patent [19]

Lecher, Sr.

[11] Patent Number: 4,619,020

[45] Date of Patent: Oct. 28, 1986

[54] RULE CLIP HOLDER FOR BELT OR THE LIKE

[75] Inventor: Bernard G. Lecher, Sr., LaCrosse, Wis.

[73] Assignee: The Stanley Works, New Britain, Conn.

[21] Appl. No.: 732,681

[22] Filed: May 10, 1985

[51] Int. Cl.[4] ..... A44B 21/00; A45F 5/02

[52] U.S. Cl. ..... 24/10 A; 24/3 E; 24/3 J

[58] Field of Search ..... 24/10 A, 3 E, 3 J, 3 L, 24/3 K, 237, 336; 224/252, 255

[56] References Cited

U.S. PATENT DOCUMENTS

| | | | |
|---|---|---|---|
| 387,329 | 8/1888 | Voorhis | 24/237 |
| 402,685 | 5/1889 | Moore | 24/336 |
| 502,529 | 8/1893 | Piggins | 24/237 |
| 533,385 | 1/1895 | Tweedale | 24/336 |
| 727,402 | 5/1903 | Messer . | |
| 781,629 | 2/1905 | Ahlstrom . | |
| 881,757 | 3/1908 | Winsor | 24/3 E |
| 942,366 | 12/1909 | Deeter | 24/336 |
| 1,170,859 | 2/1916 | Walker | 24/3 E |
| 1,469,285 | 10/1923 | Thompson | 24/3 E |
| 1,618,831 | 2/1927 | Kerns | 24/3 K |
| 3,659,759 | 5/1972 | Walton . | |
| 3,802,032 | 4/1974 | Weed | 24/336 |
| 3,886,773 | 6/1975 | McGahee . | |
| 3,970,227 | 7/1976 | Hardy . | |
| 3,992,776 | 11/1976 | Koppe et al. . | |
| 4,226,006 | 10/1980 | Toyama . | |
| 4,358,036 | 11/1982 | Maltais . | |

*Primary Examiner*—Victor N. Sakran

[57] ABSTRACT

A holder is provided for suspending a measuring rule or similar object, to which is attached a spring clip having an inwardly declined deflectable tongue portion thereon. The outer leg of the holder has a laterally extending slot configured to receive the tongue portion of the spring clip. The holder is of relatively flat, generally U-shaped configuration, and is adapted to be inserted over the belt of the user; its construction facilitates one-handed attachment and removal of the rule, without diminishing the security of interengagement afforded.

8 Claims, 8 Drawing Figures

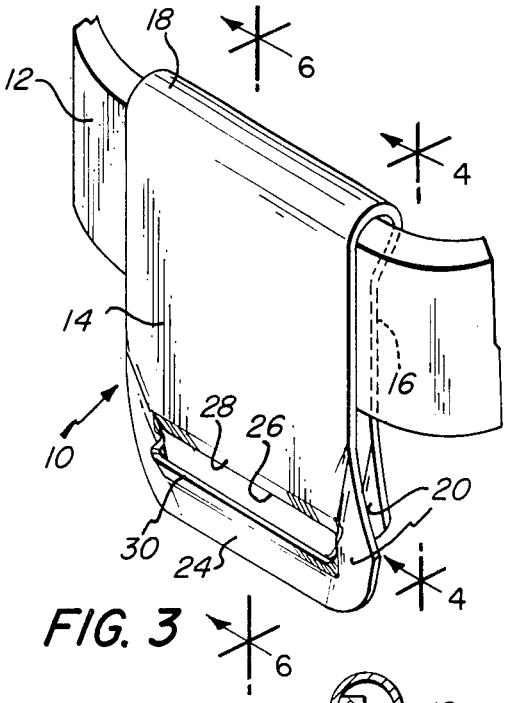
FIG. 3
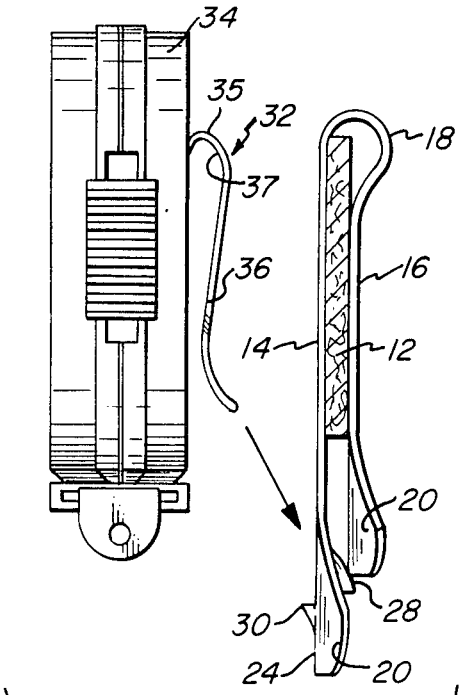
FIG. 4
FIG. 7
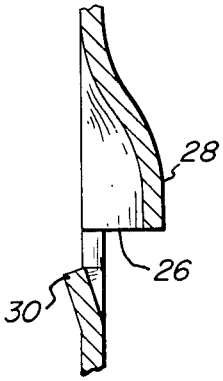
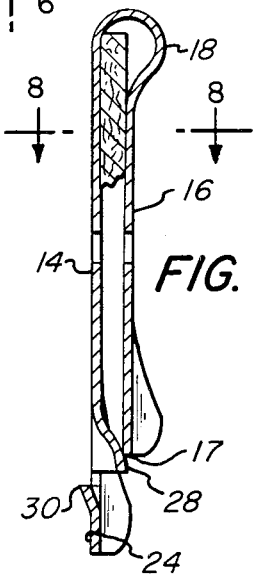
FIG. 6
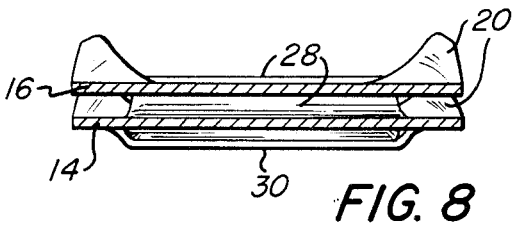
FIG. 8
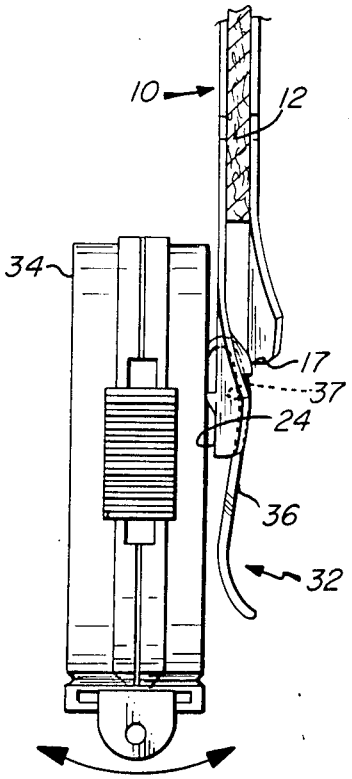
FIG. 5

RULE CLIP HOLDER FOR BELT OR THE LIKE

BACKGROUND OF THE INVENTION

Spring clips are commonly provided on tape rule casings, tools and the like, so that such objects can be carried in a handy position on a belt or other garment part, and readily removed for use. By themselves, however, clips of this type are not optimal in certain respects, particularly as concerns the facility and security of engagement that they afford. It is often found necessary to use both hands to insert the supporting belt into the clip, and it is not uncommon for the rule to become disengaged inadvertently, such as by contact of the instrument or tool with a part of the user's body; he is of course inconvenienced in both cases. A further disadvantage resides in the fact that the frequent attachment and removal of the clip causes unsightly marring, and undue wear, of the belt.

The broad idea of providing a supplemental belt-supported holder, for attachment of an article, a ring, or the like, is well known in the art and has been developed in a variety of forms, as evidenced by the following U.S. Pat. Nos.: 727,402; 781,629; 3,659,759; 3,886,773; 3,970,227; 3,992,776; 4,226,006; and 4,358,036. Each of the foregoing discloses a member adapted for engagement upon a belt, waistband, or other garment part. In particular, the Koppe et al U.S. Pat. No. 3,992,776 provides a spring metal band having a first, belt-retaining portion adjacent its upper end and a pair of curvilinear portions adjacent its lower end, which provide spring tension for holding a knife sheath; the Hardy U.S. Pat. No. 3,970,227 shows a belt clip which has an out-turned lip 22 and an inner bend 25; and the Maltais U.S. Pat. No. 4,358,036 discloses a belt clip having a pocket portion for receiving a tongue of a clip permanently fastened to a tool or other object (see FIG. 7).

Despite such prior activity in the art, a need remains for a holder that is capable of facile assembly with a tape rule or other object having a spring clip or similar supporting fixture thereon, for securely engaging the same against inadvertent disassembly. Of course, any such holder must itself be readily and yet securely engaged on the belt or other garment part and, as a practical matter, must also be relatively facile and inexpensive to manufacture.

Accordingly, it is an object of the present invention to provide a novel holder for suspending a tool or other article, such as a measuring rule, having a spring clip or like fixture with a resiliently deflectable tongue or insert portion thereon, which holder readily receives and securely engages the insert portion.

Another object is to provide such a holder, which is itself easily placed and securely affixed upon the belt or other supporting part, and is relatively facile and inexpensive to manufacture.

SUMMARY OF THE INVENTION

It has now been found that the foregoing and related objects of the invention are readily attained in a holder comprising generally parallel inner and outer legs, joined for resilient relative deflection by an upper connecting portion and adapted to engage a belt or similar supporting part inserted upwardly into it. The outer leg is substantially longer than the inner one, and has a relatively wide and substantially planar lower portion. A laterally extending slot is formed through the lower portion adjacent the bottom edge of the outer leg, and is dimensioned and configured for facile insertion of a tongue portion of the spring clip of the object to be supported.

In the preferred embodiments, the inner leg will also have a relatively wide and substantially planar lower portion, and both of the legs will have lower portions with inwardly extending marginal elements thereon, to facilitate insertion of the belt and to hamper inadvertent disengagement. The member comprising the holder will usually be integrally formed as a single piece from a resiliently deflectable material, such as spring steel, and it will advantageously be of substantially uniform width along its entire length.

BRIEF DESCRIPTION OF THE DRAWINGS

FIG. 3 is a perspective view showing a second holder embodying the invention engaged upon a belt, the latter being fragmentarily illustrated.

FIG. 4 is an elevational view of the holder of FIG. 3, taken through line 4—4 thereof and also showing a measuring rule positioned for insertion of the tongue portion of its spring clip into the holder slot;

FIG. 5 is a fragmentary view, similar to FIG. 4, showing the rule assembled with the holder;

FIG. 6 is a sectional view of the holder, taken along line 6—6 of FIG. 3 and showing a fragment of the belt;

FIG. 7 shows a portion of FIG. 6 in the area of the slot, drawn to a greatly enlarged scale; and FIG. 8 is a sectional view taken along line 8—8 of FIG. 6, drawn to a scale slightly enlarged therefrom and with the belt removed.

DETAILED DESCRIPTION OF THE ILLUSTRATED EMBODIMENT

Figure 1:
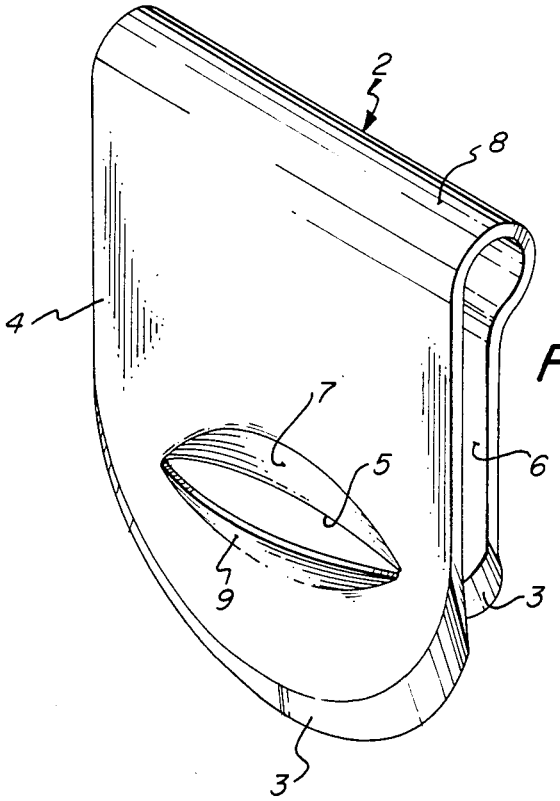
FIG. 1 is a perspective view showing a holder embodying the invention.
Figure 2:
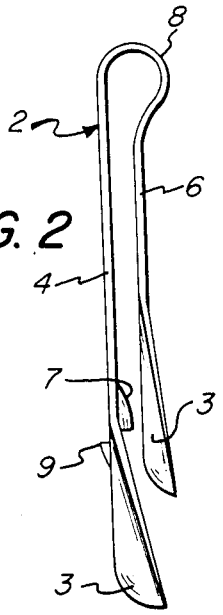
FIG. 2 is an elevational view of the holder of FIG. 1.

Turning now in detail to FIGS. 1 and 2 of the appended drawing, therein illustrated is a holder embodying the present invention, generally designated by the numeral 2. The holder is of relatively flat, generally U-shaped cross section, and is integrally formed from a single strip of spring steel or the like, bent upon itself to provide an outer leg 4 and a shorter inner leg or tang 6, both of which extend downwardly (in the position of normal use) from a curvilinear upper connecting portion 8.

Each of the legs 4, 6 is generally planar, and has a lower marginal portion 3 which is inwardly curled; the curved portion of the inner leg facilitates mounting of the holder upon the belt, and that on the outer leg provides an element beneath the lower edge of a belt on which it is mounted, positioned to interfere therewith and thus minimize the chance of inadvertent disassembly. In addition, the lower portion of the outer leg 4 has an elongated, laterally extending slot 5 formed through it, defined by upper and lower lip elements 7, 9, which curve inwardly and outwardly, respectively, from the plane of the leg.

FIGS. 3–8 illustrate a somewhat different holder embodying the invention, which is generally designated by the numeral 10 and is shown in position on a belt 12. The holder is also of relatively flat, generally U-shaped cross section, and is similarly formed from a single strip to provide an outer leg 14 and a shorter inner leg 16, which extend from the curvilinear connecting portion 18.

Each of the generally planar legs 14, 16 has lower corner portions 20 which are inwardly curled to perform the same functions of the portions 3 of the embodiment of FIGS. 1 and 2; their relationship to the belt 12 is best seen in FIGS. 4 and 5. In addition, the lower portion of the outer leg 14 has a slot 26 similarly defined by curved upper and lower lip elements 28, 30. In this instance however the marginal element 24, defined on the outer leg 14 below the slot 26, is relatively narrow, and the terminal edge 17 of the tang 16 is biased to a normal position against the inner surface of the upper lip element 28.

In FIGS. 4 and 5, a measuring tape rule of standard design is associated with the holder 10. It includes a conventional retainwing spring clip, generally designated by the numeral 32, attached to one side of its casing 34 and having a resiliently deflectable tongue portion 36. The latter declines toward the casing from an upper connecting portion 35, and defines a space 37 which is relatively side at the top and tapers toward the free end of the tongue portion.

As depicted in FIG. 5 the holder is attached to the belt, and supportingly engages the rule; the tongue portion 36 of the clip 32 thereof is inserted through the slot 26 of the outer leg 14, to thereby seat the upper connecting portion 35 upon the outwardly extending lower lip element 30. Because the marginal element 24 is narrow, the distance that the outer leg 14 projects into the space 37 is limited, thereby avoiding undue interference with the clip and permitting the rule to pivot freely on the edge of the lip element 30, as suggested by the double-headed arrow in FIG. 5. This in turn allows the rule to yield rather than being displaced (and thereby disassembled), such as by contact with the hip or upper thigh of the user when he bends or crouches.

In both embodiments, the mutually offset relationship of the lip elements 7, 9 and 28, 30, respectively, and the positioning of the slots 5 and 26 well below the upper edge of the belt, will contribute to the facility of assembly and removal of the rule, which can normally be achieved with one hand. Also, the upper lip elements and the bent portions at the lower edges of the outer legs cooperate with the inner legs to retain the holder upon the belt. It will generally be necessary that the legs of the holder be flexed somewhat, for insertion as well as for removal; conversely, their inherent tension helps to minimize the possibility that disassembly will occur inadvertently. The relative positions and configurations of the lower portions of the two legs will, on the other hand, make attachment to the belt easy and convenient; moreover, since the supported article remains in place the damage that might otherwise be caused to the belt, by its frequent removal and replacement, will be substantially reduced.

As noted above, the holder will desirably be fabricated from a uniformly wide strip of spring steel, and conventional bending and stamping operations may be used. It will however be appreciated that other materials (notably plastics) can be substituted, with suitable fabrication methods being adopted, as appropriate. Specific aspects of manufacture, as well as variations in design, will be evident to those skilled in the art from the foregoing detailed description, and need not therefore be discussed in further detail.

Thus, it can be seen that the present invention provides a novel holder for suspending an article, such as a measuring rule, having a spring clip or like fixture with a resiliently deflectable tongue or insert portion thereon. The holder readily receives and is securely engaged by the tongue portion of the clip; it is easily placed and securely affixed upon a belt, and is relatively facile and inexpensive to manufacture.

Having thus described the invention, what is claimed is:

1. A holder for supporting a measuring rule or like object, which object has a spring clip thereon with a resiliently deflectable tongue portion declining inwardly from an upper connecting portion, said holder comprising generally parallel inner and outer legs joined by an upper, resiliently deflectable connecting portion and adapted to engage the user's belt or similar supporting part inserted upwardly therebetween, said outer leg being sustantially longer than said inner leg and having a relatively wide and substantially planar lower portion with a laterally extending slot formed therethrough adjacent the lower edge thereof, said slot being dimensioned and configured for facile insertion of the tongue portion of the spring clip of the object to be supported, said lower portion having at least one terminal element thereon which extends inwardly a distance sufficient to hamper inadvertent disengagement of said holder from a belt inserted between said legs.

2. The holder of claim 1 wherein said inner leg also has a relatively wide and substantially planar lower portion.

3. The holder of claim 2 wherein said lower portion of said inner leg also has at least one inwardly extending terminal element thereon to facilitate insertion of the belt therebetween.

4. The holder of claim 3 wherein said terminal elements are inwardly curled and extend continuously along the lower margins of said legs.

5. The holder of claim 1 wherein said member is integrally formed as a single piece from a resiliently deflectable material.

6. The holder of claim 5 wherein said member is of substantially uniform width along its length.

7. The holder of claim 5 wherein said member is an open-ended, relatively flat loop of spring steel.

8. In combination, an object having a spring clip thereon with a resiliently deflectable, gently curved tongue portion which declines inwardly from an upper connecting portion, to define a space thereadjacent, and thereafter declines outwardly from the point of closest approach to said object; and a holder in the form of an open-ended, relatively flat loop of spring steel of substantially uniform width along its length, and comprising generally parallel inner and outer legs joined by an upper, resiliently deflectable connecting portion and adapted to engage the user's belt or similar supporting part inserted upwardly therebetween, said legs having relatively wide and sustantially planar lower portions, said lower portion of said outer leg having a laterally extending slot formed therethrough adjacent its lower edge, said slot being dimensioned and configured for facile insertion of said tongue portion of said spring clip therethrough, and said object being thereby supported by said holder, said outer leg portion also having at least one terminal element thereon which extends inwardly a distance sufficient to hamper inadvertent disengagement of said holder from a belt inserted between said legs.

* * * * *